United States Patent [19]

Gallardo

[11] Patent Number: 4,638,596

[45] Date of Patent: Jan. 27, 1987

[54] SAFETY LOCK FOR SECURITY WINDOW GRATINGS

[76] Inventor: Mike Gallardo, 16829 E. 14th St., San Leandro, Calif. 94578

[21] Appl. No.: 773,935

[22] Filed: Sep. 9, 1985

[51] Int. Cl.[4] ..... E06B 3/68

[52] U.S. Cl. ..... 49/56; 49/141; 49/402; 292/267

[58] Field of Search ..... 49/56, 57, 141, 50, 49/402, 394; 292/267, 305

[56] References Cited

U.S. PATENT DOCUMENTS

| | | | |
|---|---|---|---|
| 911,175 | 2/1909 | Stevenson et al. | 49/141 |
| 1,773,751 | 8/1930 | Reidhaar | 292/267 |
| 2,345,720 | 4/1944 | Winge | 292/267 |
| 2,409,007 | 10/1946 | Young | 49/14 |
| 4,249,345 | 2/1981 | Littleton | 49/56 |

FOREIGN PATENT DOCUMENTS

| | | | |
|---|---|---|---|
| 102945 | 1/1924 | Switzerland | 292/267 |

*Primary Examiner*—Kenneth J. Dorner
*Assistant Examiner*—Gerald A. Anderson
*Attorney, Agent, or Firm*—Linval B. Castle

[57] ABSTRACT

In a hinged security window grating that cannot be opened from the outside but which is readily releasably from within by the lowering of a vertical locking bar that engages the closed grating. The release mechanism includes a tubular member attached to the building wall for slideably engaging the lower end of the locking bar. The tubular member and corresponding point on the locking bar have slots which are engaged by one end of a pivoted lever, the opposite end of which has a pedal which, when depressed, pivots the lever so that it withdraws from the slots to permit the locking bar to vertically drop to release its lock on the grating.

2 Claims, 2 Drawing Figures

SAFETY LOCK FOR SECURITY WINDOW GRATINGS

CROSS REFERENCE TO RELATED APPLICATION

The improved safety lock described and claimed herein is directly related to this applicant's co-pending patent application, Ser. No. 629,207, filed July 9, 1984 and entitled "Security Window Gratings with Safety Locks".

BRIEF SUMMARY OF THE INVENTION

This invention relates to locks for security window gratings which cannot be opened from the window's exterior but which is readily opened from within.

Steel security gratings are invaluable as a means of preventing burglaries and other unauthorized access through windows of homes and places of business. However, unless the grating may be quickly and easily opened from within the structure, occupants may be unable to unlock the grating for emergency entering or escape through the window.

A co-pending U.S. patent application, Ser. No. 629,207, filed July 9, 1984, describes and claims embodiments of hinged gratings that cannot be opened from the exterior of the building to which they are attached but which may readily be opened from within. In one embodiment, the gratings include horizontal bars with flattened ends certaining holes which engage vertical locking rods. The locking rod extends down to a point near the floor of the building and is locked against vertical movement, and therefore the release of the latch bars, by a pin that locks the rod to wall mounted bushing. To open the security grating, a person within the building only need pull the pin from the rod to permit the rod to drop further toward the floor to release its locking action on the grating latch bar. Since the release pin in the locking rod is near the floor, an outsider is unable to reach through the locked grating barring an open or broken window to release the pin.

While the locking mechanism described in the co-pending application is very reliable and provides positive security against intruders, the emergency release of a grating is very difficult for the elderly, infirm or those in that class of persons who are unable to bend down to a point near the floor to pull the release pin in cases of emergency. The present improvement provides a means for quickly releasing the vertical locking rod by merely stepping on a pedal, or by pressing the pedal with a cane or crutch.

Briefly described, the invention includes the security grating, horizontal latch bar and vertical locking rod discussed above but the release pin therein has been replaced with a spring biased pedal having an arm that engages a notch in the locking rod. By pressing the pedal with the foot, cane or other convenient means, the pedal arm is released from the locking rod notch to permit the rod to drop to release the latch bar securing the hinged grating. When the improved security lock of the invention is installed in hospitals, sanitariums, rest homes, or the like, the action of the release pedal may be used to close an electrical switch coupled to a suitable alarm for alerting office or staff members of the opening of the security grating.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
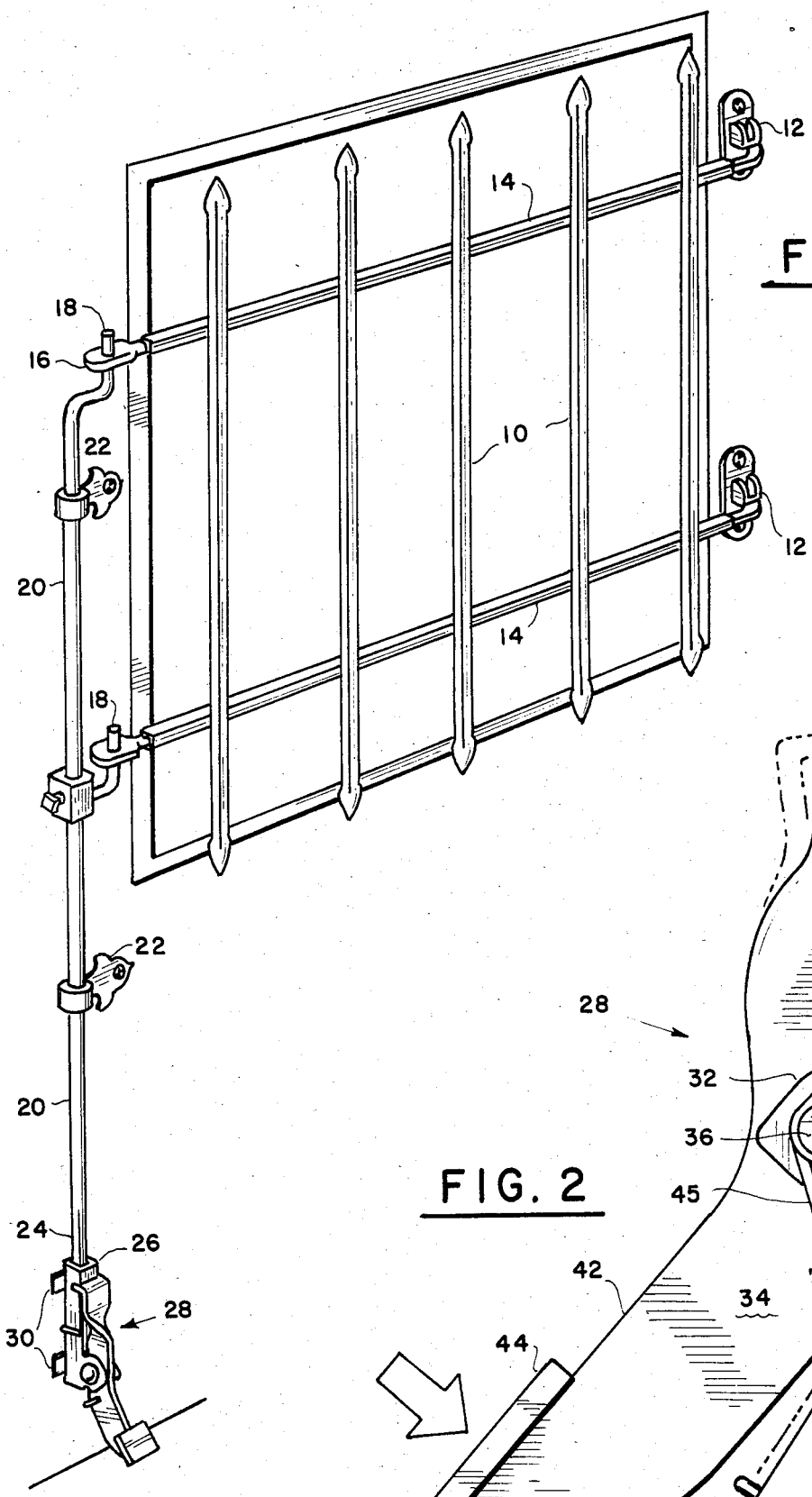
FIG. 1 is a perspective view illustrating an interior hinged security grating with the pedal release of the invention.

Illustrated in FIG. 1 is a security grating 10 mounted to the interior of a building by suitable hinges 12 that may be bolted or otherwise firmly attached to the building wall. The opposite ends of the horizontal members 14 of the grating that are pivotally attached to the hinges 12 are flattened in a substantially horizontal plane 16 and contain holes for engaging vertically aligned ends 18 of two or more branches of a vertical locking rod 20. The rod 20 is slideably attached to the wall adjacent the window frame by suitable bushings 22, and a square section 24 at the bottom end of the rod is slideably positioned in a square tube 26 forming a part of the wall mounted pedal release 28 as best illustrated in FIG. 2.

Figure 2:
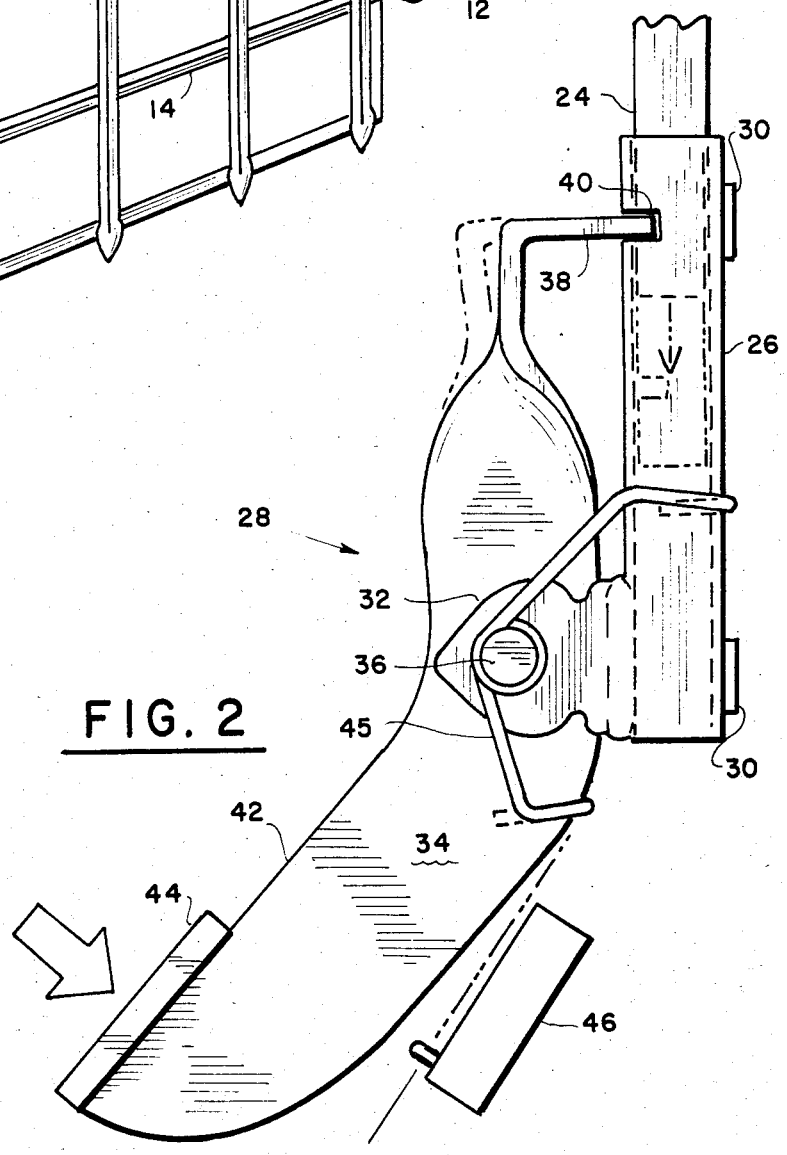
FIG. 2 is a side elevational view of the pedal release.

FIG. 2 is a side elevational view of the pedal operated rod release 28 which normally retains the locking rod 20 in a raised position so that it locks the security grating 10. The rod release includes the vertically mounted square tubular section 26 into which the squared end 24 of the vertical locking rod 20 is slideably positioned. Flat flanges 30 are welded to the wall side of the tubular section 26 for securing the section to the building wall, and a U-shaped flange 32 is welded to the opposite side and near the lower end of the section for pivotally mounting a pedal lever 34.

At its approximate center, the pedal lever 34 is pivotally mounted by a rivet 36 to the U-shaped flange 32. The end 38 of the pedal lever extending above the pivot point is flat and bent into a plane that is substantially parallel with the building floor and at right angles to the longitudinal axis of the locking rod 20. The flat end 38 of the pedal lever is positionable within a mating slot 40 through the wall of the square tubular section 26 and into a corresponding slot cut in the face of the squared end 24 of the vertical locking rod 20 to thereby lock the rod 20 against vertical movement.

The lower end 42 below the pivot point of the pedal lever 34 supports a foot plate 44 and the end 42 is preferable bent outward so that the pedal lever 34 may be pivoted by a downward component of force on the plate 44. A spring 45 coiled around the pivot rivet 36 and having a first end engaging the back of the pedal lever lower end 42 and a second end engaging the wall side of the square tubular section above the pivot point applies an inward force to the pedal lever upper end 38 and assures its engagement with the slot 40 and the locking rod.

A downward force on the foot plate 44 will thus rotate the pedal lever 34 about the pivot point rivet 36 and remove the flat upper end 38 from the slot 40 to release the locking rod 20 and to permit it to drop so that its upper ends 18 will release from the horizontal bars 14 in the grating 10.

As earlier mentioned, the pivotal rotation of the lever 34 may be sensed by an electrical switch 46 coupled to an alarm system for alerting building occupants that a security grating is open.

What is claimed is:

1. A security grating system for securing a window of a building against outside intrustion including:

a window covering grating having first and second side ends, said grating being hinged on a first side end thereof to the building wall, said grating having locking means on the second side end thereof for locking engagement with a vertical rod;

a substantially vertical locking rod slideably positioned adjacent the second side end of said grating, in a raised position said locking rod being in locking engagement with said grating locking means, in a lowered position said locking rod being released from locking engagement with said grating locking means, said locking rod vertically extending from said grating locking means to a point near the floor level of said building and having a horizontal groove in a side surface of said rod at a position above said point;

a tubular member attached to said building and slideably engaging a lower portion of said locking rod; and a lever bar having first and second ends, said second end supporting a pedal, the first end of said lever bar being horizontally bent to engage the horizontal groove in the side surface of said locking rod, said lever bar being pivotally coupled near its center to said tubular member, said lever bar being spring biased into locking engagement in the groove in said locking rod when said locking rod is in locking engagement with said grating locking means.

2. The security grating system claimed in claim 1 further including an electrical switch positioned adjacent the second end of said pedal lever, said switch being closed by a movement of said lever sufficient to release the first end of said lever from the slotted opening in said tubular member for electrically actuating an associated alarm.

* * * * *